US005540850A

United States Patent [19]

Foster

[11] Patent Number: 5,540,850

[45] **Date of Patent: * Jul. 30, 1996**

[54] DETERGENT COMPOSITION WITH FABRIC SOFTENING PROPERTIES

[75] Inventor: Francis G. Foster, Merseyside, England

[73] Assignee: Lever Brothers Company, Division of Conopco, Inc., New York, N.Y.

[ * ] Notice: The term of this patent shall not extend beyond the expiration date of Pat. No. 5,160,641.

[21] Appl. No.: 255,496

[22] Filed: Jun. 8, 1994

Related U.S. Application Data

[63] Continuation of Ser. No. 942,570, Sep. 9, 1992, abandoned, which is a continuation of Ser. No. 635,809, Jan. 2, 1991, Pat. No. 5,160,641, which is a continuation of Ser. No. 443,813, Nov. 29, 1989, abandoned, which is a continuation of Ser. No. 231,621, Aug. 11, 1988, abandoned, which is a continuation of Ser. No. 870,600, Jun. 4, 1986, abandoned.

[30] Foreign Application Priority Data

Jul. 29, 1985 [GB] United Kingdom ..... 8519047

[51] Int. Cl.[6] ..... D06M 13/325; D06M 13/46; D06M 15/05

[52] U.S. Cl. ..... 510/330; 510/331

[58] Field of Search ..... 252/8.6, 8.8, 8.9, 252/174.19, 547, 528, DIG. 2, DIG. 15

[56] References Cited

U.S. PATENT DOCUMENTS

| | | | |
|---|---|---|---|
| 2,697,695 | 12/1954 | McDonald | 252/116 |
| 3,920,561 | 11/1975 | DesMarais et al. | 252/8.8 |
| 3,920,565 | 11/1975 | Morton | 252/8.75 |
| 3,928,213 | 12/1975 | Temple et al. | 252/8.8 |
| 4,000,093 | 12/1976 | Nicol et al. | 252/529 |
| 4,020,015 | 4/1977 | Bevan | 252/544 |
| 4,041,205 | 8/1977 | Compa et al. | 428/220 |
| 4,100,094 | 7/1978 | Burns et al. | 252/8.9 |
| 4,136,038 | 1/1979 | Pracht et al. | 252/8.8 |
| 4,174,305 | 11/1979 | Burns et al. | 252/545 |
| 4,230,590 | 10/1980 | Wixon | 252/97 |
| 4,237,016 | 12/1980 | Rudkin et al. | 252/8.8 |
| 4,292,035 | 9/1981 | Battrell | 8/137 |
| 4,298,480 | 11/1981 | Wixon | 252/8.75 |
| 4,326,971 | 4/1982 | Wixon | 252/8.75 |
| 4,329,237 | 5/1982 | Wixon | 252/8.75 |
| 4,338,204 | 7/1982 | Spadini et al. | 252/8.75 |
| 4,379,059 | 4/1983 | Hockey et al. | 252/8.8 |
| 4,416,811 | 11/1983 | Wixon | 252/8.75 |
| 4,464,271 | 8/1984 | Munteanu et al. | 252/8.6 |
| 4,532,067 | 7/1985 | Padron et al. | 252/174.17 |
| 4,540,499 | 9/1985 | Sakatani et al. | 252/8.75 |
| 4,732,693 | 3/1988 | Hight | 252/132 |
| 4,772,413 | 9/1988 | Massaux et al. | 252/102 |
| 5,009,800 | 4/1991 | Foster | 252/8.9 |
| 5,128,055 | 7/1992 | Foster | 252/8.9 |
| 5,160,641 | 11/1992 | Foster | 252/8.6 |

FOREIGN PATENT DOCUMENTS

| | | |
|---|---|---|
| 0054325 | 7/1981 | European Pat. Off. . |
| 0100125 | 2/1984 | European Pat. Off. . |
| 0194127 | 9/1986 | European Pat. Off. . |
| 2632218 | 1/1977 | Germany . |
| 715149 | 8/1970 | South Africa . |
| 0071549 | 1/1971 | South Africa . |
| 1314897 | of 0000 | United Kingdom . |
| 1442295 | 8/1972 | United Kingdom . |
| 1537288 | 4/1975 | United Kingdom . |
| 1459935 | 12/1976 | United Kingdom . |
| 1498520 | 1/1978 | United Kingdom . |
| 1534641 | 12/1978 | United Kingdom . |
| 2038353 | 7/1980 | United Kingdom . |

OTHER PUBLICATIONS

Eric Jungermann "Cationic surfactant" 1970 no month available pp. 40–41,64–65.

Kunieda et al. "Solubility Behavior of Dialkydimethyl ammonium in water. Basic properties of anti–static. Fabric softeners"J. Phys. Chem. 1978 PP. 1710–1713.

*Primary Examiner*—Paul Lieberman
*Assistant Examiner*—Michael P. Tierney
*Attorney, Agent, or Firm*—Gerard J. McGowan, Jr.

[57] ABSTRACT

A fabric treatment composition contains at least a detergent active material, a fabric softening agent and 0.5 to 3% a nonionic substituted cellulose ether derivative which has an HLB of 3.1 to 4.3 and a gel point of less than 58° C., which improve softening performances on cotton while controlling deposition on synthetic fabrics. Ethyl, hydroxyethyl or methyl hydroxyethyl cellulose ethers are preferred. The detergent active material is anionic or a mixture thereof with other detergent active materials and may be present at 2 to 50% of the composition. The softening agent may be soap, a cationic material, a fatty amine and/or a clay with a soap/cationic mixture being preferred, and may be present at 0.5 to 50% of the composition.

4 Claims, No Drawings

DETERGENT COMPOSITION WITH FABRIC SOFTENING PROPERTIES

This is a continuation application of Ser. No. 07/942,570, filed Sep. 9, 1992 now abandoned, which is a continuation of Ser. No. 07/635,809, filed Jan. 2, 1991, which issued as U.S. Pat. No. 5,160,641 on Nov. 3, 1993, which is a continuation of Ser. No. 07/443,813, filed Nov. 29, 1989, now abandoned which is a continuation of Ser. No. 07/231,621, filed Aug. 11, 1988 now abandoned, which is a continuation of Ser. No. 06,870,600, filed Jun. 4, 1986 now abandoned.

This invention relates to a detergent composition for treating fabrics in particular to such compositions which are capable of softening natural fibre wash load articles without causing redeposition problems on any synthetic fibre fabrics in the load. In particular the invention is directed to compositions capable of achieving an optimum balance of softening and detergency across a mixed fibre wash load.

It is desirable to overcome the possible harshening of fabrics which may result from repeated washing by treating the fabrics with a fabric softening agent either during the fabric washing step or in a subsequent fabric rinsing operation. Amongst the materials proposed as fabric softening agents are quaternary ammonium compounds, imidazolinium derivatives, fatty amines, fatty amine oxides, soaps, clays and mixtures thereof. Harshening of fabrics is a particular problem when the fabric is formed of or contains natural fibres such as cotton and wool. A problem associated with the deposition of organic fabric softening agents on fabrics during the wash is that to achieve a desirable degree of softening effect on fabrics, an increase in the deposition of fatty and particulate soil occurs on synthetic fabrics, leading to unsightly discolouration.

Products designed for cleaning fabrics often contain in addition to a detergent active material to remove soil from the fabric, an anti-redeposition material to reduce the redeposition of the removed soil from the wash liquor back onto the fabrics. Sodium carboxy methyl cellulose (SCMC) is one material used for this purpose. It reduces redeposition of clay and soot (or carbon) particulate soils onto hydrophilic fabrics such as cotton but not on hydrophobic fabrics.

For hydrophobic fabrics, such as polyester and acrylic fabrics, problems of redeposition are particularly extreme because the redeposition problem is one of organic fatty soil together with particulate, inorganic, soil.

The problem of redeposition on hydrophobic fabrics can be alleviated by incorporation of certain nonionic cellulose ether polymers, as described in South African Patent Specification No 71/5149 (UNILEVER).

It is proposed in U.S. Pat. No. 3,920,561 (DESMARIS assigned to THE PROCTER AND GAMBLE COMPANY) to treat fabrics with a composition comprising a fabric softener and a highly substituted methyl cellulose derivative, such as a methyl cellulose containing from 2.14 to 2.62 methyl groups per anhydroglucose ring, in order to impart superior soil release benefits, especially to polyester fabrics while simultaneously imparting fabric softness in the rinse. We have found that these specified cellulose ether derivatives and others do not increase the deposition of organic fabric softening agents on natural fibre fabrics in the wash step.

However, we have surprisingly found a selected class of nonionic cellulose ether derivatives which, in addition to controlling redeposition on synthetic fibres, are capable of enhancing fabric softening in the wash step on natural fibre fabrics.

Thus, according to the invention there is provided a fabric treatment composition comprising (i) a non-soap anionic detergent active material or a mixture thereof with other non-soap detergent active materials;

(ii) a fabric softening agent; and (iii) from 0.5% to 3% by weight of a water-soluble nonionic substituted cellulose ether derivative having an HLB (as herein defined) of between 3.1 and 4.3, preferably between 3.3 and 3.8, and a gel point (as herein defined) of less than 58° C., preferably between 33° C. and 56° C. provided that the derivative contains substantially no hydroxyalkyl groups containing 4 or more carbon atoms.

The useful substituted cellulose ether derivatives are defined in part by their HLB. HLB is a well known measure of the hydrophilic-lyophilic balance of a material and can be calculated from its molecular structure. A suitable estimation method for emulsifiers is described by J T Davies, 2nd Int Congress of Surface Activity 1957, I pp 426–439. This method has been adopted to derive a relative HLB ranking for cellulose ethers,by summation of Davies's HLB assignments for substituent groups at the three available hydroxyl sites on the anhydroglucose ring of the polymer. The HLB assignments for substituent groups include the following:

| | | |
|---|---|---|
| Residual hydroxyl | 1.9 | |
| Methyl | 0.825 | |
| Ethyl | 0.350 | |
| Hydroxy ethyl | 1.63 | |
| Hydroxy propyl | 1.15 | |
| Hydroxy butyl | 0.67 | (by extrapolation from Davies) |

The cellulose ether derivatives useful herein are polymers. The gel point of polymers can be measured in a number of ways. In the present context the gel point is measured on a polymer solution prepared at 10 g/l concentration in deionised water by heating 50 ml solution placed in a beaker, with stirring, at a heating rate of approximately 5° C./minute. The temperature at which the solution clouds is the gel point of the cellulose ether being tested and is measured using a Sybron/Brinkmann colorimeter at 80% transmission/450 nm.

Provided that the HLB and gel point of the polymer fall within the required ranges, the degree of substitution (DS) of the anhydroglucose ring may be any value up to the theoretical maximum value of 3, but is preferably from about 1.9–2.9, there being a maximum of 3 hydroxyl groups on each anhydroglucose unit in cellulose. The expression 'molar substitution' (MS) is sometimes also used in connection with these polymers and refers the number of hydroxyalkyl substituents per anhydroglucose ring and may be more than 3 when the substituents themselves carry further substituents.

The most highly preferred polymers have an average number of anhydroglucose units in the cellulose polymer, or weight average degree of polymerisation, from about 50 to about 1,200. For certain product forms, e.g. liquids, it may be desirable to include polymers of relatively low degree of polymerisation to obtain a satisfactory product viscosity.

A number of cellulose ether derivatives suitable for use in the present invention are commercially available, as follows:

| Trade Name | Gel point °C. | HLB (Davies) | DS/MS alkyl/hydroxalkyl |
|---|---|---|---|
| BERMOCOLL CST035 (ex Berol Kemi) | 35 | 3.40 | 1.4 ethyl 0.5 hydroxyethyl |
| BERMOCOLL E481 (ex Berol Kemi) | 56 | 3.77 | 0.9 ethyl 2.0 hydroxyethyl |
| TYLOSE MHB 1000 (ex Hoechst) | 54 | 3.52 | 2.0 methyl 0.1 hydroxyethyl |

A number of other cellulose ether derivatives are known from the prior art, but have been found to be unsuitable for use in the present invention. Thus, British Specification No GB 2 038 353B (COLGATE-PALMOLIVE) discloses TYLOSE MH 300 (ex Hoechst) which has a gel point of 58° C. and METHOCEL XD 8861 (ex Dow Chemical Company, now coded METHOCEL HB12M) which contains about 0.1 hydroxybutyl substituents per anhydroglucose ring, while Japanese Patent Specification No 59-6293 (LION KK) discloses KLUCEL H (ex Hercules Chemical Corp) which has an HLB of about 4.4, METHOCEL K4M (ex Dow Chemical Company) which has a gel point of about 69° C., and NATROSOL 250H (ex Hercules Chemical Corp) which has an HLB of about 6.9. The amount of cellulose ether derivative to be employed in compositions according to the invention is from 0.5 to 3% by weight of the composition.

The compositions according to the invention necessarily contain a non-soap anionic detergent active material, which may be mixed with other non-soap detergent compounds selected from nonionic, zwitterionic and amphoteric synthetic detergent active materials. Many suitable detergent compounds are commercially available and are fully described in the literature, for example in "Surface Active Agents and Detergents", Volumes I and II, by Schwartz, Perry and Berch.

Anionic detergent active materials are usually water-soluble alkali metal salts of organic sulphates and sulphonates having alkyl radicals containing from about 8 to about 22 carbon atoms, the term alkyl being used to include the alkyl portion of higher acyl radicals. Examples of suitable synthetic anionic detergent compounds are sodium and potassium alkyl sulphates, especially those obtained by sulphating higher ($C_8$–$C_{18}$) alcohols produced for example from tallow or coconut oil, sodium and potassium alkyl ($C_9$–$C_{20}$) benzene sulphonates, particularly sodium linear secondary alkyl ($C_{10}$–$C_{15}$) benzene sulphonates; sodium alkyl glyceryl ether sulphates, especially those ethers of the higher alcohols derived from tallow or coconut oil and synthetic alcohols derived from petroleum; sodium coconut oil fatty monoglyceride sulphates and sulphonates; sodium and potassium salts of sulphuric acid esters of higher ($C_8$–$C_{18}$) fatty alcohol-alkylene oxide, particularly ethylene oxide, reaction products; the reaction products of fatty acids such as coconut fatty acids esterified with isethionic acid and neutralised with sodium hydroxide; sodium and potassium salts of fatty acid amides of methyl taurine; alkane monosulphonates such as those derived by reacting alpha-olefins ($C_8$–$C_{20}$) with sodium bisulphite and those derived from reacting paraffins with $SO_2$ and $Cl_2$ and then hydrolysing with a base to produce a random sulphonate; and olefin sulphonates, which term is used to describe the material made by reacting olefins, particularly $C_{10}$–$C_{20}$ alpha-olefins, with $SO_3$ and then neutralising and hydrolysing the reaction product. The preferred anionic detergent compounds are sodium ($C_{11}$–$C_{15}$) alkyl benzene sulphonates and sodium ($C_{16}$–$C_{18}$) alkyl sulphates.

Suitable nonionic detergent compounds which may be used include in particular the reaction products of compounds having a hydrophobic group and a reactive hydrogen atom, for example aliphatic alcohols, acids, amides or alkyl phenols with alkylene oxides, especially ethylene oxide either alone or with propylene oxide. Specific nonionic detergent compounds are alkyl ($C_6$–$C_{22}$) phenols-ethylene oxide condensates, generally 5 to 25 EO, ie 5 to 25 units of ethylene oxide per molecule, the condensation products of aliphatic ($C_8$–$C_{18}$) primary or secondary linear or branched alcohols with ethylene oxide, generally 5 to 40 EO, and products made by condensation of ethylene oxide with the reaction products of propylene oxide and ethylenediamine. Other so-called nonionic detergent compounds include long chain tertiary amine oxides, long chain tertiary phosphine oxides and dialkyl sulphoxides.

Mixtures of anionic and nonionic compounds may be used in the detergent compositions, particularly to provide controlled low sudsing properties. This is beneficial for compositions intended for use in suds-intolerant automatic washing machines.

Amounts of amphoteric or zwitterionic detergent compounds can also be used in the compositions of the invention but this is not normally desired due to their relatively high cost. If any amphoteric or zwitterionic detergent compounds are used it is generally in small amounts.

The effective amount of the detergent active compound or compounds used in the composition of the present invention is generally in the range of from 2 to 50%, preferably from 5 to 40% by weight, most preferably not more than 30% by weight of the composition.

A second essential component of the compositions of the present invention is a fabric softening agent which may be selected from quaternary ammonium compounds, imidazolinium derivatives (both of which are cationic fabric softening agents), fatty amines, soaps, fabric softening clays (particularly organo-modified clays) and mixtures thereof.

The fabric softening material is preferably a cold water-insoluble material, that is a material having a solubility at 20° C. of less than 10 g/l in water at a pH value of about 6 or a material which will form an insoluble calcium salt in hard water.

Highly preferred water-insoluble quaternary ammonium compounds are those having two $C_{12}$–$C_{24}$ alkyl or alkenyl chains, optionally substituted by functional groups such as ——OH, ——O——, ——CONH, ——COO—— etc.

Well known species of substantially water-insoluble quaternary ammonium compounds have the formula

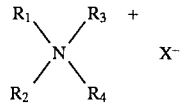

wherein $R_1$ and $R_2$ represent hydrocarbyl groups from about 12 to about 24 carbon atoms; $R_3$ and $R_4$ represent hydrocarbyl groups containing from 1 to about 4 carbon atoms; and X is an anion, preferably selected from halide, methyl sulfate and ethyl sulfate radicals. Representative examples of these quaternary softeners include ditallow dimethyl ammonium chloride; ditallow dimethyl ammonium methyl sulfate; dihexadecyl dimethyl ammonium chloride; di(hydrogenated tallow alkyl) dimethyl ammonium chloride; dioctadecyl dimethyl ammonium chloride; dieicosyl dimethyl ammonium chloride; didocosyl dimethyl ammonium chloride; di(hydrogenated tallow) dimethyl ammonium methyl sulfate; dihexadecyl diethyl ammonium chloride; di(coconut alkyl) dimethyl ammonium chloride. Ditallow dimethyl ammonium chloride, di(hydrogenated tallow alkyl) dimethyl ammonium chloride, di(coconut alkyl) dimethyl ammonium chloride and di(coconut alkyl) dimethyl ammonium methosulfate are preferred.

Another class of preferred water-insoluble cationic materials are the alkylimidazolinium salts believed to have the formula:

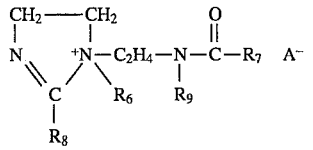

wherein $R_6$ is an alkyl or hydroxyalkyl group containing from 1 to 4, preferably 1 or 2 carbon atoms, $R_7$ is an alkyl or alkenyl group containing from 8 to 25 carbon atoms, $R_8$ is an alkyl or alkenyl group containing from 8 to 25 carbon atoms, and $R_9$ is hydrogen or an alkyl containing from 1 to 4 carbon atoms and A is an anion, preferably a halide, methosulfate or ethosulfate. Preferred imidazolinium salts include 1-methyl-1-(tallowylamido-) ethyl -2-tallowyl- 4,5-dihydro imidazolinium methosulfate and 1-methyl-1-(palmitoylamido)ethyl -2-octadecyl-4,5- dihydro- imidazolinium chloride. Other useful imidazolinium materials are 2-heptadecyl-1-methyl-1- (2-stearylamido) - ethylimidazolinium chloride and 2-1auryl-1-hydroxyethyl- 1-oleyl-imidazolinium chloride. Also suitable herein are the imidazolinium fabric softening components of U.S. Pat. No. 4,127,489, incorporated by reference. As used herein the term "fabric softening agent" excludes, cationic detergent active materials which have a solubility above 10 g/l in water at 20° C. at a pH of about 6.

Preferred fabric softening agents include water-insoluble tertiary amines having the general formula:

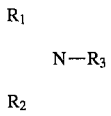

wherein $R_1$ is a $C_{10}$–$C_{26}$ alkyl or alkenyl group, $R_2$ is the same as $R_1$ or if $R_1$ is a $C_{20}$–$C_{26}$ alkyl or alkenyl group, may be a $C_1$–$C_7$ alkyl group and $R_3$ has the formula —$CH_2$—Y, wherein Y is H, $C_1$–$C_6$ alkyl O, —$CH_2OH$, —CH=$CH_2$, —$CH_2CH_2OH$,

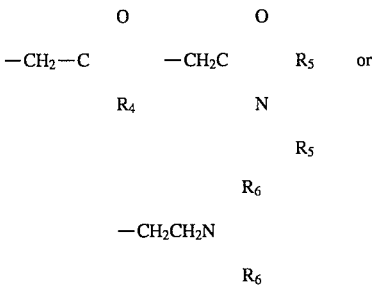

wherein $R_4$ is a $C_1$–$C_4$ alkyl group, each $R_5$ is independently H or $C_1$–$C_{20}$, and each $R_6$ is independently H or $C_1$–$C_{20}$ alkyl.

Preferably $R_1$ and $R_2$ each independently represent a $C_{12}$–$C_{22}$ alkyl group, preferably straight-chained and $R_3$ is methyl or ethyl. Suitable amines include: didecyl methylamine; dilauryl methylamine; dimyristyl methylamine; dicetyl methylamine; distearyl methylamine; diarachidyl methylamine; dibehenyl methylamine; arachidyl behenyl methylamine or di (mixed arachidyl/behenyl) methylamine; di (tallowyl) methylamine; arachidyl/behenyl dimethylamine and the corresponding ethylamines, propylamines and butylamines. Especially preferred is ditallowyl methylamine. This is commercially available as Armeen M2HT from AKZO NV, as Genamin SH301 from FARBWERKE HOECHST, and as Noram M2SH from the CECA COMPANY.

When Y is 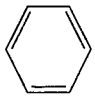 , —CH=$CH_2$, —$CH_2OH$,

—CH(OH)—$CH_3$ or —$CH_2$—CN, suitable amines include: didecyl benzylamine; dilauryl benzylamine; dimyristyl benzylamine; dicetyl benzylamine; distearyl benzylamine; dioleyl benzylamine; dilinoleyl benzylamine; diarachidyl benzylamine; dibehenyl benzylamine; di (arachidyl/behenyl) benzylamine, ditallowyl benzylamine and the corresponding allylamines, hydroxy ethylamines, hydroxy propylamines and 2-cyanoethylamines. Especially preferred are ditallowyl benzylamine and ditallowyl allylamine.

Mixtures of any of these amines may be used.

When the fabric softening agent is a soap, this includes not only the usual alkali metal and alkaline earth metal salts of fatty acids, but also the organic salts which can be formed by complexing fatty acids with organic nitrogen-containing materials such as amines and derivatives thereof. Usually, the soap comprises salts of higher fatty acids containing from 8 to 24 carbon atoms, preferably from 10 to 20 carbon atoms in the molecule, or mixtures thereof.

Preferred examples of soaps include sodium stearate, sodium palmitate, sodium salts of tallow, coconut oil and palm oil fatty acids and complexes between stearic and/or palmitic fatty acid and/or tallow and/or coconut oil and/or palm oil fatty acids with water-soluble alkanolamines such as ethanolamine, di- or triethanolamine, N-methylethanolamine, N-ethylethanolamine, 2-methylethanolamine and 2,2-dimethyl ethanolamine and N-containing ring compounds such as morpholine, 2'-pyrrolidone and their methyl derivatives.

Mixtures of soaps can also be employed.

Particularly preferred are the sodium and potassium salts of the mixed fatty acids derived from coconut oil and tallow, that is sodium and potassium tallow and coconut soap.

The level of fabric softening agent in the composition is preferably more than 0.5% by weight, such as more than 2% by weight in order to provide a noticeable fabric softening benefit. Preferably not more than 50% by weight, such as not more than 20% by weight of fabric softener is used to leave room in the formulation for other ingredients. When the fabric softening agent is a soap, a level of less than 10% by weight of the composition is sufficient to provide a fabric softening benefit.

We have found particularly beneficial effects when the fabric softening agent is a mixture of soap and either a cationic fabric softening agent or a fatty amine.

The compositions of the invention will generally include a detergency builder to improve the efficiency of the detergent active, in particular to remove calcium hardness ions from the water and to provide alkalinity. The builder material may be selected from precipitating builder materials (such as alkali metal carbonates, bicarbonates, borates, orthophosphates and silicates), sequestering builder materials (such as alkali metal pyrophosphates, polyphosphates, amino polyacetates, phytates, polyphosphonates, aminopolymethylene phosphonates and polycarboxylates), ion-exchange builder materials (such as zeolites and amorphous aluminosilicates), or mixtures of any one or more of these materials. Preferred examples of builder materials include sodium tripolyphosphate, mixtures thereof with sodium orthophosphate, sodium carbonate, mixtures thereof with calcite as a seed crystal, sodium citrate, zeolite and the sodium salt of nitrilo- triacetic acid.

The level of builder material in the compositions of the invention may be up to 80% by weight, preferably from 20% to 70% by weight and most preferably from 30% to 60% by weight.

Apart from the components already mentioned, a detergent composition of the invention can contain any of the conventional additives in the amounts in which such additives are normally employed in fabric washing detergent compositions. Examples of these additives include the lather boosters such as alkanolamides, particularly the monoethanolamides derived from palm kernel fatty acids and coconut fatty acids, lather depressants, oxygen-releasing bleaching agents such as sodium perborate and sodium percarbonate, peracid bleach precursors, chlorine-releasing bleaching agents such as tricloroisocyanuric acid, inorganic salts such as sodium sulphate, and, usually present in very minor amounts, fluorescent agents, perfumes, enzymes such as cellulases, proteases and amylases, germicides and colourants.

The compositions may be in any convenient form such as bars, powders, pastes or liquids.

PREPARATION OF THE COMPOSITION

The detergent compositions may be prepared in any way appropriate to their physical form such as by dry-mixing the components, co-agglomerating them or dispersing them in a liquid carrier. However, a preferred physical form is a granule incorporating a detergency builder material and this is most conveniently manufactured by spray-drying at least part of the composition. The cellulose ether derivative may be incorporated either by dry mixing (optionally with other ingredients in a post-dosed adjunct) or by being included with other ingredients in a slurry and spray-drying. The fabric softening agent may be incorporated as such or, in the case of a cationic fabric softening agent, it may be incorporated in the form of particles which also contain a dispersion inhibitor such as tallow alcohol as described in U.S. Pat. No. 3,936,537 (referred to above).

The invention will now be illustrated in the following non-limiting examples.

EXAMPLES 1 TO 7

Commercially available detergent compositions having the following approximate formulations were employed in these examples:

| Ingredients (parts by weight) | Base A | Base B |
|---|---|---|
| Anionic detergent active | 6.0 | 6.5 |
| Nonionic detergent active | 4.0 | 2.5 |
| Coconut alkyl trimethyl ammonium chloride | — | 1.7 |
| Ditallow methyl amine | — | 3.7 |
| Clay | — | 4.2 |
| Sodium tripolyphosphate | 32.0 | 30.0 |
| Sodium silicate | 6.0 | 7.5 |

-continued

| Ingredients (parts by weight) | Base A | Base B |
|---|---|---|
| Sodium carboxymethyl cellulose | 0.75 | 0.9 |
| Sodium sulphate | 13.9 | 12.0 |
| Sodium perborate tetrahydrate | — | 25.0 |
| Moisture and minor ingredients | 13.35 | 6.0 |
| | 76 | 100 |

In a first series of examples, a wash liquor was prepared containing 4 g/l of a product made up of 76 parts Base A, 5 parts hardened tallow soap particles, 5.0 parts of cationic particles consisting of 3.75 parts AROSURF TA100 and 1.25 parts tallow alcohol, and optionally 3 parts of a cellulose ether derivative (added as a 10 g/l solution), the balance to 100 parts being made up with sodium sulphate. This liquor was used to wash a fabric load containing artificially soiled test cloths together with terry towelling and polyester monitors in a laboratory scale apparatus using 24° FH water, a liquor to cloth ratio of about 20:1, a wash time of 15 minutes at 50° C., a 2 minute flood at 50% dilution followed by three 5 minute rinses. The fabric load was then line-dried. After drying, the terry towelling monitors were assessed for softness subjectively by expert judges who assess softness by comparison of pairs of monitors leading to preferance scores which are then adjusted to give a score of zero for the control. A positive score indicates better softness than the control. The results are set out in the following table, which for reference also quotes the gel point and the HLB of the materials used.

The polyester monitors were then assessed for redeposition of soil from the test cloths by measuring the reflectance at 460 nm using a Zeiss Elrepho spectrophotometer with a UV filter. The results are also given in the following Table, expressed in terms relative to the reflectance of the untreated polyester monitors, (ΔR).

| Example No | Cellulose ether | Softening Score | Gel Point | HLB | −ΔR |
|---|---|---|---|---|---|
| 1 | BERMOCOLL CST 035 | +1.38 | 35° C. | 3.4 | 10 |
| 2 | TYLOSE MHB 1000 | +0.83 | 54° C. | 3.5 | 7 |
| 3 | BERMOCOLL E 481 | +0.38 | 56° C. | 3.8 | 9 |
| Control | NONE | 0 | — | — | 13 |
| C | TYLOSE MH 300 | −0.25 | 58° C. | 4.1 | 10 |
| D | BERMOCOLL E150F | −0.42 | 65° C. | 4.1 | 9 |
| E | NATROSOL 250L | −0.81 | 62° C. | 6.9 | 17 |

These results demonstrate that, compared with the control, all those cellulose ether derivatives which have a gel point below 58° C. and an HLB between 3.1 and 4.3 exhibit a softening benefit. In all examples, some deposition on the polyester monitors occurred, as indicated by the negative ΔR values. The results demonstrate however that with Examples 1, 2 and 3 less redeposition occurs than with the control.

The same procedure was followed except that the wash liquor tested contained 100 parts of Base B and 3 parts of the cellulose ether derivative. The results were as set out in the following table which also gives the structure of the materials used.

| EXAMPLE NO | CELLULOSE ETHER | SOFT-ENING SCORE | STRUCTURE |
|---|---|---|---|
| 4 | BERMOCOLL CST 035 | +1.24 | 1.4 ethyl 0.5 hydroxyethyl |
| 5 | TYLOSE MHB 1000 | +1.20 | 2.0 methyl 0.1 hydroxyethyl |
| Control | NONE | 0 | — |
| F | METHOCEL HB12M | +0.96 | 2.0 methyl 0.08 hydroxybutyl |

These results demonstrate the superiority of the cellulose ether derivatives used in Examples 4 and 5 compared with the material used in Example F which contains a hydroxyalkyl group in which the alkyl portion contains 4 carbon atoms.

The same conclusion can be drawn from the following results which are obtained from wash liquors containing 4 g/l of a product made up of 100 parts Base B, 5 parts hardened tallow soap and 3 parts cellulose ether derivative:

| EXAMPLE NO | CELLULOSE ETHER | SOFTENING SCORE |
|---|---|---|
| 6 | BERMOCOLL CST 035 | +1.33 |
| 7 | TYLOSE MHB 1000 | +0.86 |
| Control | NONE | 0 |
| G | METHOCEL HB 12 M | +0.65 |

EXAMPLES 8 AND 9

Examples 1 and 3 were repeated except that the particles containing the cationic fabric softener were excluded and softness was assessed after three washes. Results were as follows:

| EXAMPLE NO | CELLULOSE ETHER | SOFTENING SCORE |
|---|---|---|
| 8 | BERMOCOLL E 481 | +1.09 |
| 9 | BERMOCOLL CST 035 | +0.64 |
| H | METHOCEL J12MS* | +0.09 |
| I | NATROSOL 250L | +0.09 |
| Control | — | 0 |
| J | METHOCEL HB12M | −0.12 |
| K | TYLOSE MH300 | −0.74 |

*A cellulose derivative having 1.1 methyl and 0.9 hydroxy propyl substituents per anhydrose ring, a gel point of 62° C. and an HLB of 3.9.

These results demonstrate the benefit of the selected cellulose ether derivatives when the fabric softening agent used is soap.

EXAMPLES 10 TO 12

Examples 1 to 3 were repeated except that in place of the particles containing the cationic fabric softener and the soap, 4 parts of di-hardened tallow methyl amine were added in the form of a 1:4 amine/perborate monohydrate adjunct of the type described in European patent specification No 137533-A (UNILEVER NV/PLC). Softness was assessed after 3 washes. The results were as follows:

| EXAMPLE NO | CELLULOSE ETHER | SOFTENING SCORE |
|---|---|---|
| 10 | BERMOCOLL E 481 | +1.53 |
| 11 | TYLOSE MHB 1000 | +1.15 |
| 12 | BERMOCOLL CST 035 | +0.56 |
| L | TYLOSE MH300 | +0.24 |
| Control | — | 0 |
| M | NATROSOL 250L | −0.26 |
| N | BERMOCOLL E150F | −0.62 |

These results demonstrate the benefit of the selected cellulose ether derivatives when the fabric softening agent is an amine.

EXAMPLE 13

Example 1 was repeated except that the soap was omitted and softness was assessed after three washes. The results were:

| EXAMPLE NO | CELLULOSE ETHER | SOFTENING SCORE |
|---|---|---|
| 13 | BERMOCOLL CST 035 | +0.31 |
| Control | — | 0 |
| O | TYLOSE MH300 | −0.18 |
| P | NATROSOL 250L | −0.88 |

EXAMPLES 14 TO 17

These examples compare the softening and detergency performance of a water-soluble cationic surfactant with a water-insoluble cationic fabric softening agent. The materials used for this example were:

| | |
|---|---|
| base composition | base A of Example 1 |
| cellulose ether derivative | BERMOCOLL CST 035 (3.0 parts) |
| cationic surfactant | myristyl trimethyl ammonium chloride (3.8 parts) |
| cationic softener | distearyl dimethyl ammonium chloride (AROSURF TA 100) (3.8 parts) |
| soap | hardened tallow soap (5.0 parts) |

The experiment was carried out in a manner similar to Example 1, except that the compositions were compared with each other and not with a control, and the results were as follows —

| Example No. | System | Softness scores (3 washes) |
|---|---|---|
| 14 | cationic surfactant | −0.33 |
| 15 | cationic softener | +0.13 |
| 16 | cationic surfactant/ soap | −0.17 |
| 17 | cationic softener/ soap | +0.36 |

These results demonstrate the benefits, from a fabric softening point of view of using a cationic softening agent, whereas the use of a cationic surfactant fails to give a softening benefit and that the same conclusion can be drawn even in the presence of soap.

I claim:

1. A fabric treatment composition comprising:

(i) from 5% to 40% by weight of a detergent active material selected from non-soap anionic detergent active materials and mixtures thereof with other non-soap detergent active materials;

(ii) from 2% to 50% by weight of an fabric softening agent selected from, cationic fabric softening agents, fatty amines, fabric softening clays and mixtures thereof, the fabric softening agent having a solubility at 20° C. of less than 10 g/l in water at a pH value of 6; and (iii) from 0.5 to 3% by weight of a nonionic substituted cellulose ether derivative having an HLB of between 3.3 and 3.8, and a gel point of between 33° C. and 56° C., the cellulosic ether derivative being selected from the group consisting of ethyl hydroxyethyl cellulose ethers and methyl hydroxyethyl cellulose ethers.

2. The fabric treatment composition according to claim 1 wherein the fabric softening agent comprises a cationic fabric softening agent containing quaternary nitrogen and also containing at least two alkyl or alkenyl chains with at least twelve carbon atoms therein.

3. A fabric treatment composition according to claim 1 in which the fabric softening agent is selected from quaternary ammonium compounds of the formula

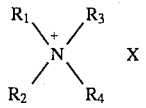

wherein $R_1$ and $R_2$ represent hydrocarbyl groups from 12 to 24 carbon atoms and $R_3$ and $R_4$ represent hydrocarbyl groups containing 1 to 4 carbon atoms; and X is an anion selected from halides, methyl sulphate and ethyl sulphate radicals.

4. The fabric teatment composition according to claim 1 wherein the fabric softening agent is selected from cationic fabric softening agents and fatty amines, and wherein the composition also contains soap.

* * * * *